United States Patent [19]

Wöhrle et al.

[11] Patent Number: 4,805,673

[45] Date of Patent: Feb. 21, 1989

[54] PROCESS AND DEVICE FOR DISPENSING PREDETERMINED DOSES HAVING A PRECISE WEIGHT OF A FLUID FILLING MATERIAL

[75] Inventors: Ernst Wöhrle, Heidenheim-Oggenhausen; Claudio Anselmino, Cologne, both of Fed. Rep. of Germany

[73] Assignees: Carl Edelmann Verpackungstechnik GmbH, Heidenheim; Bayer AG, Leverkusen, both of Fed. Rep. of Germany

[21] Appl. No.: 116,074

[22] PCT Filed: Jan. 27, 1987

[86] PCT No.: PCT/DE87/00031

§ 371 Date: Sep. 24, 1987

§ 102(e) Date: Sep. 24, 1987

[87] PCT Pub. No.: WO87/04404

PCT Pub. Date: Jul. 30, 1987

[30] Foreign Application Priority Data

Jan. 28, 1986 [DE] Fed. Rep. of Germany ..... 3602493

[51] Int. Cl.[4] ..... B65B 1/04; B65B 1/34

[52] U.S. Cl. ..... 141/10; 141/21; 141/128

[58] Field of Search ..... 141/128, 10, 21

[56] References Cited

U.S. PATENT DOCUMENTS 4,381,545 4/1983 Biddle, III et al. ..... 141/128 X

*Primary Examiner*—Werner H. Schroeder

*Attorney, Agent, or Firm*—Nies, Webner, Kurz & Bergert

[57] ABSTRACT

Process and device for filling packaging containers, in particular tubular bags or similar packages, with doses having a predetermined weight of a fluid, powdery or finely granulated filling material, with the filling material being gravimetrically introduced into the packaging containers such that the predetermined amount of filling material to be introduced into the packaging container is fed by means of a speed-controlled metering screw at intervals, gravimetrically regulated, from a first filling material supply, and a measured amount of the filling material more or less equivalent to the amount dispensed is subsequently fed from a second filling material supply to the first filling material supply within a time corresponding to the stop period of the packing machine.

3 Claims, 2 Drawing Sheets

PROCESS AND DEVICE FOR DISPENSING PREDETERMINED DOSES HAVING A PRECISE WEIGHT OF A FLUID FILLING MATERIAL

The invention pertains to a process for filling packaging containers, such as tubular bags or similar packages, with doses having a predetermined weight of a fluid, powdery or finely granulated filling material, the filling material being gravimetrically introduced into the packaging containers, and also pertains to a device for filling such containers, in accord with the process, with doses having a predetermined weight of a fluid, powdery or finely granulated filling material, the device having a speed-controlled, motor-driven delivery screw in a jacket pipe flanged to the discharge end of a supply container for the filling material according to the generic term of claims 1 and 3.

Up to now, it has been customary to measure out a predetermined amount of a fluid filling material and introduce it into packaging containers, particularly tubular bags, in two ways. The metering takes place volumetrically according to the one method and gravimetrically according to the second method.

The volumetric metering has the disadvantage of being extraordinarily inexact, which results in substantial weight differences with regard to the contents of the packages. Wherever greater accuracy in portioning the filling material is important, subsequent metering systems with cut-off scales are usually used; however, these can not be used for tubular bag packing machines, due to the connection of the packaging container to the packing machine. But these apparatus as well, which supposedly allow relatively high precision to be reached, reveal that in practice this is not sufficient after all, since the overfilling necessary due to the stipulations of the ordinance on finished packaging reaches a degree which leads to considerable losses for the filling company. This state of affairs is made clear in more detail by the example depicted below.

If, for instance, a package is supposed to contain 1,000 g of a filling material, then the amount of shortage conditioned by the filling may not exceed 15 g. As experience shows that the filling device works with a tolerance of ±20 g, on the average of all packages, a median minimum weight of 1,005 g of the amount dispensed arises. This means that the overfilling amounts to at least 5 g per package. If, for example, 1.2 million packages are produced in one year, then the overfilling amounts to at least 6,000 kg per year. Supposing that one kilogram costs 20.00 German marks, a loss of 120,000.00 German marks arises from the overfilling of only 5 g in a 1,000 g package.

The invention is based on the task of substantially improving the metering accuracy in the automatic dispensing of a certain amount of a fluid, powdery or finely granulated filling material, in order to reduce to a minimum the overfilling of the package conditioned by the system, which has been necessary up to now for reasons of tolerance and which can reach substantial proportions, while complying with the legal stipulations of the ordinance on finished packaging.

For the solution of this task it is proposed according to the invention, that in a process for filling packaging containers, a predetermined amount of filling material to be introduced into a packaging container is fed by means of a speed-controlled metering screw at intervals, gravimetrically regulated, from a first supply of filling material, and a measured amount of the filling material more or less equivalent to the amount dispensed is subsequently fed from a second filling material supply to the first filling material supply within a time corresponding to the stop period of the packing machine. It is contemplated as preferable, that delivery of the measured amount of filling material from the first supply takes place in two steps, with a greater portion of this amount being delivered at a higher conveying speed and the remaining amount at a substantially reduced conveying speed.

A further object realized by this invention is a novel device for filling packaging containers, such as tubular bags or the like, with doses having a predetermined weight of a powdery or finely granulated fluid filling material, the device including a first speed-controlled, motor-driven delivery screw in a jacket pipe connected to the discharge end of a supply container for the filling material, wherein the filling material supply container is mounted on weight gauges, and a second feed screw, regulated with regard to the number of its rotations is disposed above the filling material supply container, and a control device is associated with the filling arrangement, to which control device the measuring data from the weight gauges is continuously fed and which, to reach the specified filling amount from the supply container, sends control pulses via timed switching steps to a regulator which induces a number of rotations of the shaft of the drive motor of the first delivery screw necessary during a predetermined time and to also control the rotation of the drive motor for the second feed screw.

In the drawing, the device for carrying out the process according to the invention is shown on the basis of a particularly preferred embodiment.

Figure 1:
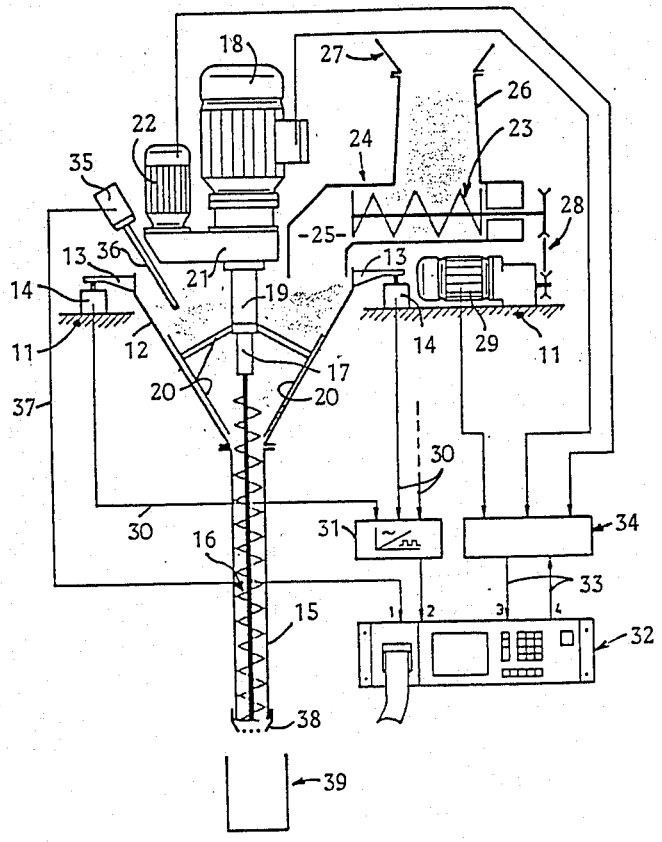
FIG. 1 shows a schematic representation of the device according to the invention for the metered, precisely weighed dispensing of a predetermined amount of a fluid, powdery or finely granulated filling material in a particularly advantageous manner.

A frame 11 carried by a mount not shown in more detail serves to support the filling material container 12, which rests with its three claws 13 on weight gauges 14. The jacket pipe 15, in which the delivery screw 16 coupled to the drive shaft 17 of the drive motor 18 is located, is flanged onto the lower discharge end of the conical filling material container 12. The hollow shaft 19 surrounding the drive shaft 17 and driving the agitator blade 20 situated in the interior of the conical filling material container 12 is connected via a gear unit 21 to the agitator drive motor 22. A feed screw 23 with its screw casing 24 having a discharge 25 projecting without contact into the filling material container 12 is disposed above the frame 11. The feed screw casing 24 is connected via a pipe connection 26 to a reservoir 27, not shown in detail, for the filling material. The feed screw 23 is caused to rotate by the drive motor 29 via the gear unit 28.

Figure 2A:
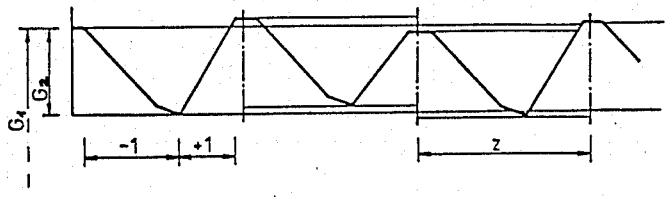
FIG. 2A is a chart which shows the working cycles of the machine of FIG. 1 with weight of material dispensed from and into the filling supply container plotted against time.
Figure 2B:
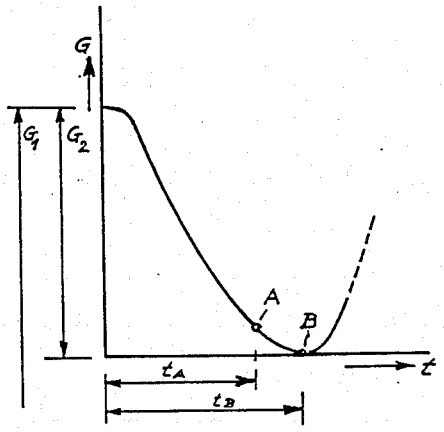
FIG. 2B is a curve corresponding to the container filling phase of FIG. 2A, but is a more realistic curve of weight v. time than that depicted by the theoretical curve of FIG. 2A.

The weight gauges 14 are connected over the electric lines 30 via a measuring amplifier and analog-to-digital converter 31 to a control device 32 which edits the values transmitted to it. The control device 32 processes the aforementioned values and sends and receives pulses over the lines 33 to and from the motor regulator 34, which in turn controls the drive motors 18 and 29 in accordance with the given nominal curve of the time/-weight diagram specific to the product, of which one is shown as an example in FIG. 2B. For control purposes and for maintenance of a certain level in the filling material container 12, a probing device 35 is provided, with the sensor 36 thereof projecting into the filling material container 12. This device is likewise connected to the control device 32 over the line 37.

The device described above and shown in FIG. 1 is operated according to the invention in the manner described in more detail below.

In order to achieve as great a metering accuracy as possible, the amount of filling material on supply at a time in the filling material container 12 is kept relatively small and constant, in order for the weights and weight differences of the device supported on the weight gauges 14 to remain as small as possible. By means of the constant amount in the filling material container 12 at a time, the static pressure prevailing at each place is approximately equal and is thus subject only to slight, negligible fluctuations conditioned by the system. Furthermore, in the selected embodiment it is possible for the most part to suppress, if not even completely avoid, influences such as vibrations acting on the system from the outside. This likewise has a positive effect on the improvement of the metering accuracy. The vertical delivery screw 16 in the jacket pipe 15 surrounding it is driven, and this cyclically, as evident in particular in the curves shown in FIG. 2A, by the drive motor 18, preferably a phase controlled electromotor, with a rotational speed adjustable to a specific value between 0 and 1200 rpm. With this the delivery screw 16 conveys a predetermined amount of the filling material into the packaging container 39 disposed below the lower orifice 38. As soon as the predetermined amount of filling material has been delivered, the control device 32 switches off the drive motor 18 via the motor regulator 34, whereby any further delivery of filling material is stopped. At the same time the drive motor 29 is switched on, whereby the feed screw 23 feeds approximately as much filling material into the filling material container 12 as was taken from it beforehand. From then on, the weight, determined by the weight gauges, of the device, including its contents, braced against the weight gauges, is taken as a basis in the delivery of the next amount of filling material, as likewise simply shown in FIG. 2A.

For practical purposes, the delivery by the delivery screw 16 takes place in two steps. In the first step approximately 90 to 95% of the filling material to be discharged in doses is delivered, and in the second step, with reduced rotational speed of the delivery screw 16, the remainder is delivered, in order in this way to likewise improve the accuracy in the desired manner.

We claim:

1. Process for filling packaging containers, with a predetermined amount, having a predetermined weight, of a fluid, powdery or finely granulated filling material, said filling material being gravimetrically introduced into the packaging containers, the improvement being in that in the first step the predetermined amount of filling material to be introduced into the packaging container is fed by means of a speed-controlled metering screw at intervals, gravimetrically regulated, from a first filling material supply, and in a second step a measured amount of the filling material approximately equivalent to the amount dispensed in the first step is subsequently fed from a second filling material supply to the first filling material supply within a time period corresponding to the period between the dispensing of material from said first material supply to two successive packaging containers.

2. Process according to claim 1, characterized in that the delivery of the predetermined amount of filling material from said first filling material supply takes place in two steps, with the greater portion of this amount being delivered first at a first conveying speed and the remaining amount being delivered second at a second conveying speed, said second speed being substantially reduced relative to said first speed.

3. Device for filling packaging containers with a predetermined amount, having a predetermined weight, of a fluid, powdery or finely granulated filling material, said device comprising: a first filling material supply container means having a container (12) with an upper inlet opening and a lower discharge end; a discharge screw means with a delivery screw (16) and an enclosing jacket pipe, said pipe connected to said discharge end of the first supply container, and a motor (18) drivingly connected to said delivery screw (16); said device including a plurality of weight gauges (14); said supply container means and said discharge screw means being mounted on said weight gauges; a feed screw (23) with a drive motor (29) and an associated casing (24) with an inlet adapted to be connected to a source of filling material and an outlet (25) disposed above the upper inlet opening of said first filling material supply container; a motor regulator (34) connected to control the rotations of the motors (18,29) for said discharge screw means and said feed screw so that said feed screw is regulated with regard to the number of its rotations during the cycle which includes operation of the discharge screw means and of the feed screw; a control device with circuit connections to said two drive motors (18,29) and said weight gauges (14) to send control pulses to said regulator (34) to induce the required number of rotations of the drive motor (18) of the delivery screw means (16) necessary in a predetermined time of the operational cycle to result in delivery of a gravimetrically determined weight and volume of filling material out from said lower discharge end and to thereafter control rotation of the drive motor (29) for the feed screw (23) during a latter portion of the operational cycle to replenish the approximate amount, by volume, of the material dispensed from the first filling material supply container means.

* * * * *